US007137809B2

(12) United States Patent
Bueche et al.

(10) Patent No.: US 7,137,809 B2
(45) **Date of Patent: *Nov. 21, 2006**

(54) METHOD FOR THE PRODUCTION OF A BURNER UNIT

(75) Inventors: Dirk Bueche, Stuehlingen (DE); Rolf Dornberger, Nehausen am Rheinfall (CH); Petros Koumoutsakos, Zurich (CH); Christian Oliver Paschereit, Berlin (DE); Bruno Schuermans, Basel (CH); Peter Stoll, Ammerbuch-Poltringen (DE)

(73) Assignee: Alstom Technology Ltd., Baden (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/470,557

(22) PCT Filed: Jan. 30, 2002 (Under 37 CFR 1.47)

(86) PCT No.: PCT/IB02/00282

§ 371 (c)(1), (2), (4) Date: Jul. 20, 2004

(87) PCT Pub. No.: WO02/061335

PCT Pub. Date: Aug. 8, 2002

(65) Prior Publication Data

US 2005/0084811 A1 Apr. 21, 2005

(30) Foreign Application Priority Data

Jan. 30, 2001 (DE) ..... 101 04 151

(51) Int. Cl.
*F23N 1/02* (2006.01)
*F23C 7/00* (2006.01)

(52) U.S. Cl. ..... 431/12; 431/351; 60/39.28

(58) Field of Classification Search ..... 431/12 O, 431/351 X, 352; 60/39.281 X, 737, 446; 137/6

See application file for complete search history.

(56) References Cited

U.S. PATENT DOCUMENTS 4,735,052 A 4/1988 Maeda et al.

(Continued)

FOREIGN PATENT DOCUMENTS

DE 39 10 869 A1 10/1989

(Continued)

OTHER PUBLICATIONS

Search Report from DE 101 04 151.9 (Oct. 8, 2004).

(Continued)

*Primary Examiner*—Alfred Basichas
(74) *Attorney, Agent, or Firm*—Cermak & Kenealy, LLP; Adam J. Cermak

(57) ABSTRACT

In the case of swirl-stabilized premix burners (1), an axial mass flow distribution of the fuel introduced which has especially favorable values with respect to characteristics such as $NO_x$ emission and maximum amplitudes of pulsations occurring is used. For this purpose, Pareto solutions are determined with respect to the said characteristics, in that a distributing device (5) with control valves is represented by a tree structure with distributing parameters, and values for the distributing parameters on the basis of which the distributing device (5) is set by means of a control unit (10) are iteratively generated in a data-processing system (9) by an evolutionary algorithm. On the basis of the values determined by a measuring unit (11), solutions which are especially favorable with respect to the characteristics mentioned, especially Pareto-optimal, are selected. The distributing devices or the premix burners of the burner system are then formed in a way corresponding to such a solution.

13 Claims, 6 Drawing Sheets

U.S. PATENT DOCUMENTS

| | | | | |
|---|---|---|---|---|
| 5,361,586 | A * | 11/1994 | McWhirter et al. | 60/737 |
| 5,713,206 | A * | 2/1998 | McWhirter et al. | 60/747 |
| 5,855,009 | A | 12/1998 | Garcia et al. | |
| 6,095,793 | A * | 8/2000 | Greeb | 431/12 |
| 6,606,580 | B1 * | 8/2003 | Zedda et al. | 702/185 |

FOREIGN PATENT DOCUMENTS

| | | | |
|---|---|---|---|
| DE | 44 46 945 | A1 | 7/1996 |
| EP | 1 067 338 | A2 | 1/2001 |
| GB | 2 287 312 | A | 9/1995 |
| WO | 00/73861 | A1 | 12/2000 |

OTHER PUBLICATIONS

Chipperfield, A.J., J.P Flemming, "More Integrated Gas Turbine Engine Controller Design." In: Second Intern. Conf. in Genetic Algorithms in Engineering Systems: Innovations and Applications, Sep. 1997.

Search Report in International Application PCT/IB02/00282 (Mar. 19, 2002).

Paschereit, C.O., et al., "Structure and Control of Thermoacoustic Instabilities in a Gas-turbine Combustor", Combust. Sci. and Tech., vol. 138, pp. 213-232 (Overseas Publishers Association N.V., 1998, Malaysia).

* cited by examiner

METHOD FOR THE PRODUCTION OF A BURNER UNIT

This is a national stage application under 35 U.S.C. § 371 of International application number PCT/IB02/00282, filed 30 Jan. 2002, and claims priority therethrough under 35 U.S.C. § 119 to German application number 101 04 151.9, filed 30 Jan. 2001.

TECHNICAL FIELD

The invention relates to a method for producing a burner system of the type used in gas turbines.

PRIOR ART

It is known that burner systems of the generic type, with customary swirl-stabilized premix burners, in which the fuel is introduced usually more or less uniformly over the length, have problematical characteristics in various respects to do with the way in which the combustion proceeds. In particular, the exhaust gases often contain a considerable proportion of pollutants, especially $NO_x$. Pressure waves induced by pulsating combustion also often present difficulties, since they subject the gas turbine to high mechanical loads and reduce its service life.

To alleviate these problems, it has been proposed to stabilize the combustion by influencing the pressure in the burner system by means of feedback. For this purpose, in that case the pressure was measured and the measured signal fed in again in a phase-shifted manner via loudspeakers. In this way it was possible to achieve a more stable combustion and, as a result, a reduction in the formation of pressure waves and also the $NO_x$ and CO emissions. See in this respect C. O. Paschereit, E. Gutmark, W. Weisenstein: 'Structure and Control of Thermoacoustic Instabilities in a Gas-turbine Combustor', Combust. Sci. and Tech. 138 (1998), pages 213–232. The required expenditure in terms of apparatus is very considerable, however.

SUMMARY OF THE INVENTION

The invention is based on the object of providing a method for producing burner systems of the generic type which are of a simple construction and in which the combustion proceeds favorably, in particular with regard to the reduction of pulsations and low emission of pollutants, especially $NO_x$. It was found that the way in which the combustion proceeds is influenced strongly by the mass flow distribution of the fuel introduced into the premix burners.

According to the invention, the burner systems are formed in such a way that the fuel is introduced into the premix burners with a specific mass flow distribution, which ensures favorable characteristics of the combustion, especially with regard to pulsations and pollutant emission.

BRIEF DESCRIPTION OF THE DRAWINGS

The invention is explained in more detail below on the basis of figures, which merely represent an exemplary embodiment and in which FIG. 1 schematically shows a premix burner with an upstream distributing device, FIG. 2 schematically shows a setup of a test system with a premix burner corresponding to FIG. 1 and a distributing device and also a data-processing system for determining favorable mass flow distributions.

FIG. 4 shows the determination set of a typical optimization problem and its mapping onto the corresponding target set and FIGS. 5*a, b* show steps in the selection of new determination variables from previously generated test variables in the target domain;

WAYS OF IMPLEMENTING THE INVENTION

Figure 1:
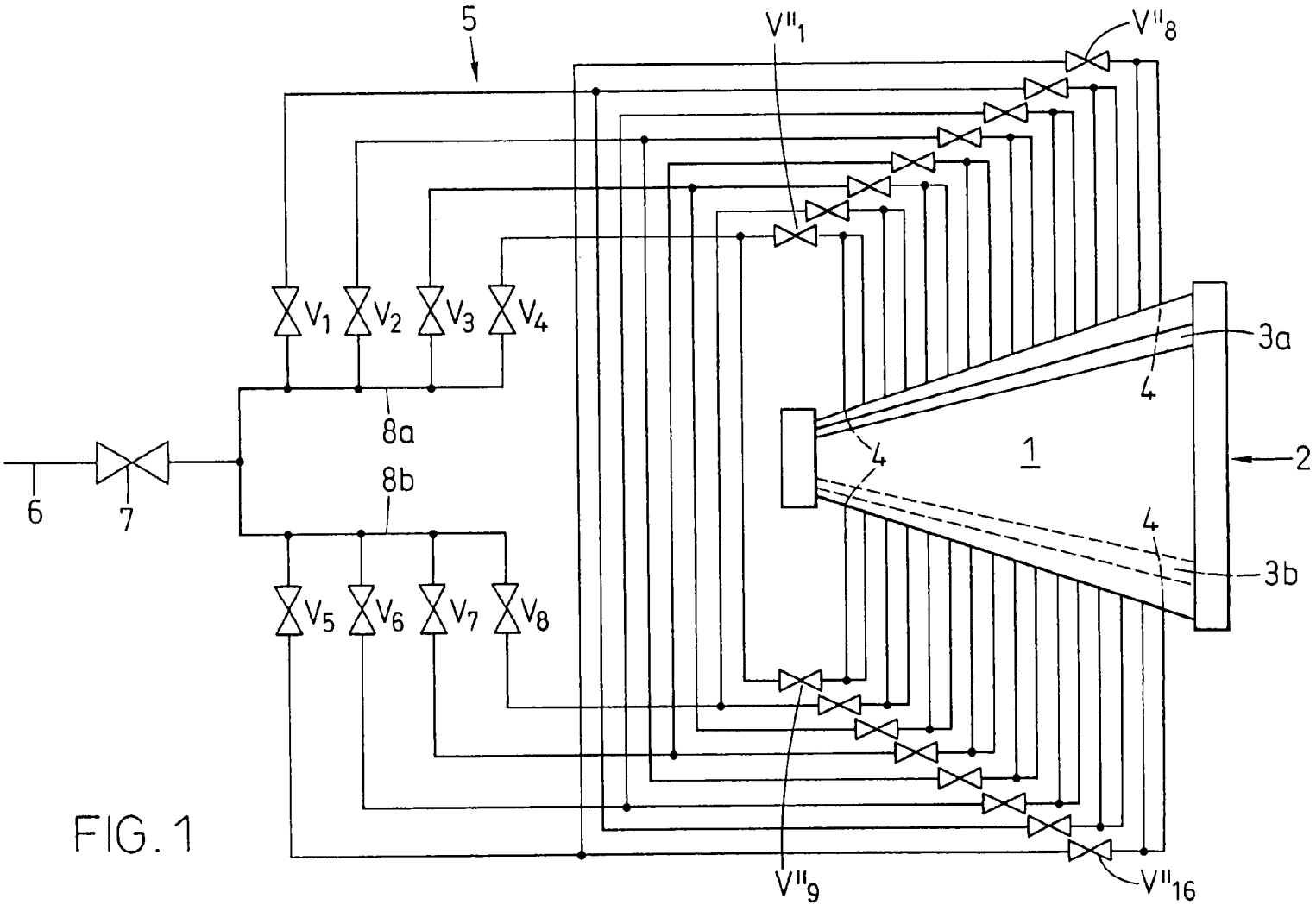

A premix burner 1 (FIG. 1) of a fundamentally known construction, as used in an internal combustion engine of a gas turbine, has the form of a truncated cone with an outflow opening 2 at its wide end. Provided along two diametrically opposite generatrices are air inlet slots 3*a, b*, on the outer sides of each of which 16 inlet openings 4 for the fuel supply are arranged, forming the end points on the burner side of a distributing device 5.

Figure 2:
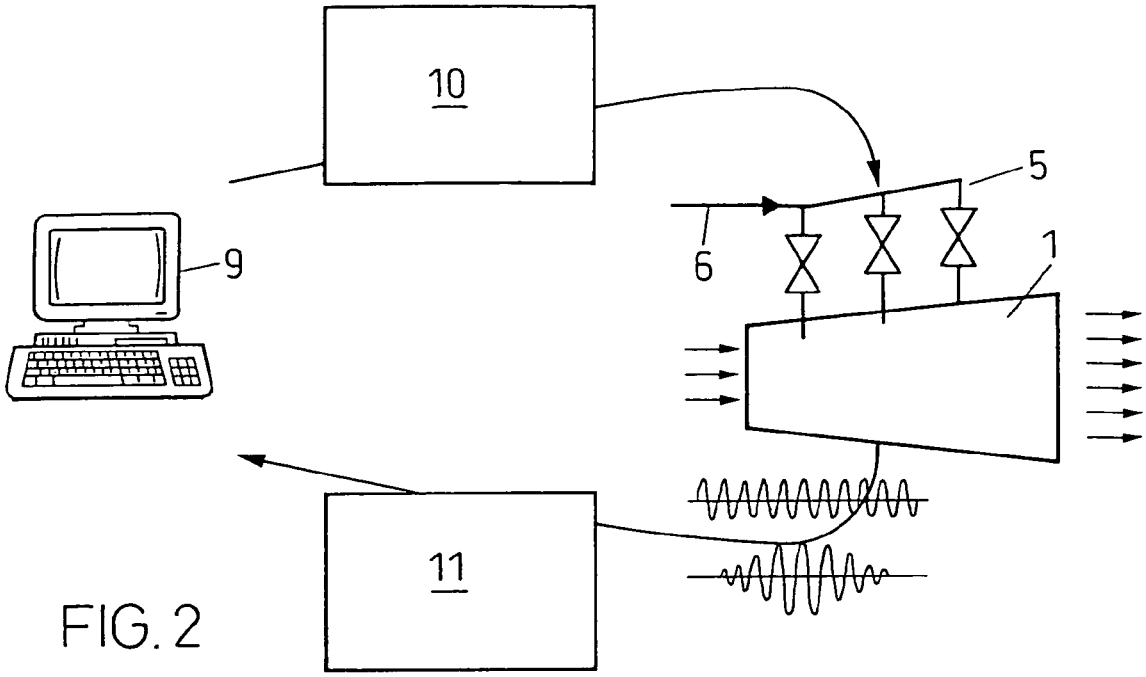

In the course of producing a burner system, firstly mass flow distributions which are as favorable as possible with regard to a target variable, the components of which are formed by specific characteristics, especially the emission of $No_x$ and the maximum of amplitudes of pressure surges occurring, are formed. This takes place by means of a test setup (FIG. 2), in which a distributing device 5 suitable for test purposes, which may be formed for example as represented in FIG. 1, is arranged upstream of a premix burner 1 formed as described in connection with FIG. 1.

The input of the distributing device 5 is formed by a feed line 6, which is connected to a fuel source, for example a stationary gas line (not represented) and is provided with an input valve 7, which limits the fuel supply. Subsequently, the main line 6 branches into two branch lines 8*a,b*, from each of which there branch off four supply lines, in which a control valve is respectively located. The control valves are designated by $V_1$ to $V_8$. Following the respective control valve, the supply line branches to two pairs of inlet openings 4, lying opposite each other, to be precise in such a way that two axially successive groups of four inlet openings respectively have fuel applied to them via one of the control valves $V_1, \ldots, V_8$. The control valves $V_1, \ldots, V_8$ are formed in such a way that specific mass flows $m_1, \ldots m_8$ can be set with them. The two inlet openings 4 arranged on the same side are preceded in each case by an on/off valve. By means of the on/off valves $V''_1, \ldots, V''_{16}$, it is possible in each case for the fuel supply to two successive inlet openings 4 to be selectively blocked.

Figure 3:
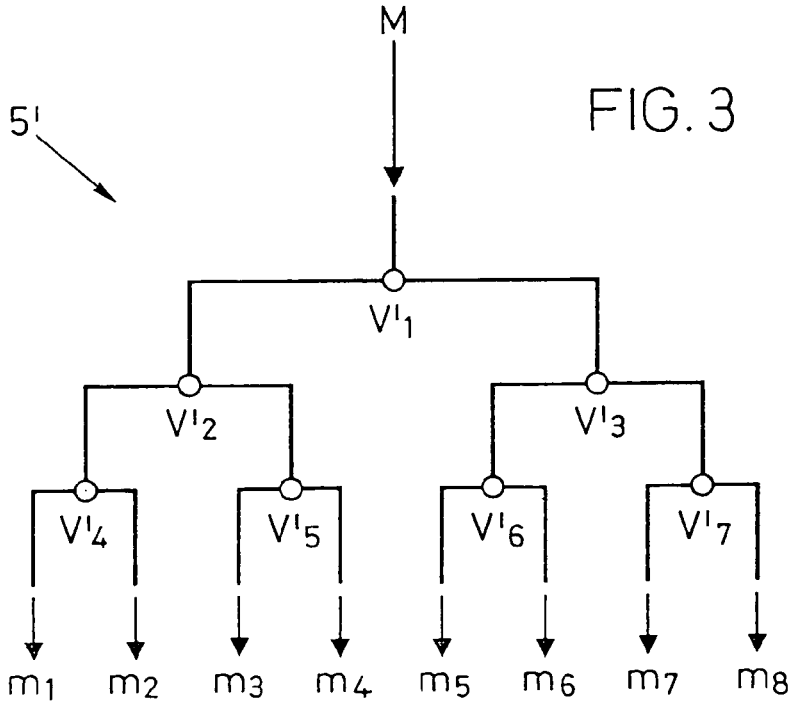
FIG. 3 shows a diagram of a tree structure as a simplified model for the mass flow distribution.

The construction of the distributing device 5 may deviate in many respects from that described. For instance, each control valve may be assigned a larger or smaller group of inlet openings or else only a single inlet opening. The on/off valves may be inserted at a different location or else be omitted, or such valves may be used exclusively, for example one for each inlet opening. The topology may also be different, for example it may correspond to the distributing device 5' represented in FIG. 3 (FIG. 3), a tree structure comprising three-way valves, as described in more detail further below. The tests of which the results are given further below were carried out with a distributing device which corresponded to that represented in FIG. 1, but without the on/off valves $V''_1, \ldots, V''_{16}$.

The control valves $V_1, \ldots, V_8$ of the distributing device 5 are set by a control unit 10 on the basis of values output by the data-processing system 9. A measuring unit 11 supplies the measured characteristics of the burner system to the data-processing system 9. For the representation of the mass flow distribution in the data-processing system 9, the distributing device 5 is mapped onto the distributing device 5' (FIG. 3), i.e. a model in which it is represented by a binary tree structure comprising three-way valves $V'_1, \ldots, V'_7$ is used and it is assumed that the total mass flow respectively has a fixed value M. The position of each of the three-way valves can be represented by a distributing parameter p, $0 \leqq p \leqq 1$, which corresponds to the proportion attributed to the left-hand output in the distribution of the mass flow between the left-hand and the right-hand output. If the individual mass flows at the output of the control valves $V_1, \ldots, V_8$ are designated by $m_1, \ldots, m_8$, the distributing parameter of the valve $V'_1$ becomes $p_1=(m_1+\ldots+m_4)/M$, that of the valve $V'_2$ becomes $p_2=(m_1+m_2)/(m_1+\ldots+m_4)$, etc., and conversely $m_1, \ldots, m_8$ can easily be calculated from the distributing parameters $p_1, \ldots, p_7$ on the basis of $m_1=Mp_1p_2p_4$, $m_2=Mp_1p_2(1-p_4)$, and so on. The fact that the data-processing system 9 works with the model described has the effect that only seven parameters are required, and consequently the dimension of the determination domain (see below) is reduced by 1.

If, as in the present case, optimization is carried out with regard to a number of independent characteristics, it is generally not possible to select a specific optimum solution, but nevertheless a set of so-called Pareto-optimal solutions can be found, respectively characterized in that they are not Pareto-dominated, i.e. that there is no other solution which would be more favorable with regard to one characteristic and no less favorable with regard to any of the other characteristics. To put it another way, a solution which is more favorable with regard to at least one characteristic than a Pareto-optimal solution is inevitably less favorable than the latter with regard to at least one other characteristic.

The target variables of the Pareto-optimal solutions usually form a portion of a hypersurface in the target domain defined by the target variables, known as the Pareto front, which bounds the target set, i.e. the set of target variables of all the possible solutions, from areas of the target domain which would be more favorable but are not accessible. The Pareto front is adjoined by further hypersurface portions bounding the target domain, which contain solutions which although not Pareto-optimal under some circumstances are nevertheless of interest.

Suitable for the search for Pareto-optimal solutions are semi-stochastic methods, which are based for example on the natural process of evolution of living beings by crossing, mutation and selection and are accomplished by means of so-called evolutionary algorithms. These are used for iteratively approximating Pareto-optimal solutions on the basis of specific, for example randomly distributed, starting variables for a set of determination variables, in that the determination variables are varied with each iteration step, for example by recombinations and random mutations, and a new set of determination variables is selected from the test variables produced in this way, by selection based on the corresponding target variables. As soon as a specific terminating criterion is satisfied, the iteration is terminated.

Figure 4:
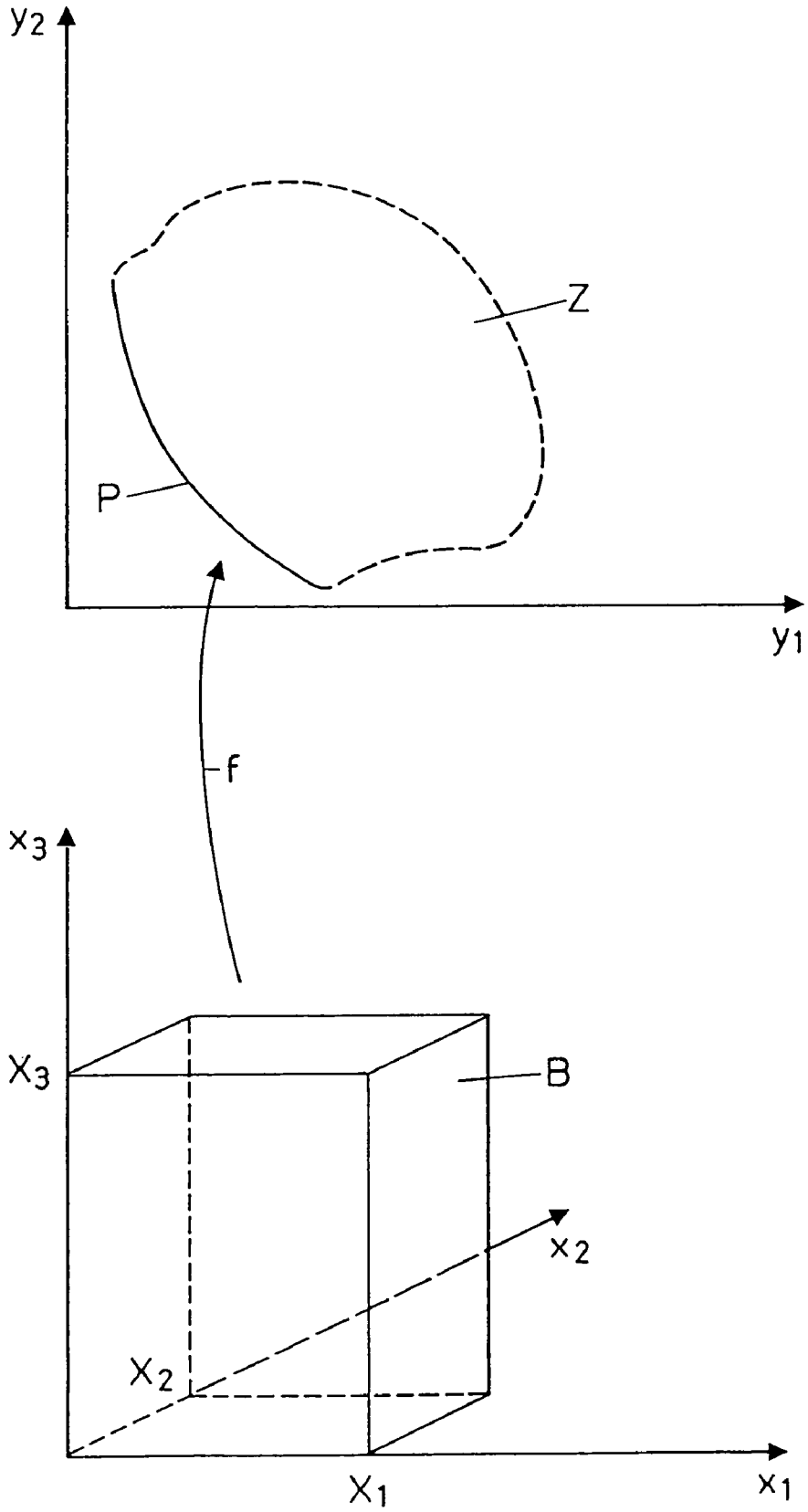
FIGS. 4, 5*a,b* generally show the optimizing method used for the determination of favorable mass flow distributions, where

Represented in FIG. 4 is a situation in which the determination domain is 3-dimensional, with parameters $x_1$, $x_2$ and $x_3$. The determination set B over which the determination variable is varied is restricted by the variables respectively lying between zero and an upper limit $X_1$, $X_2$ and $X_3$, respectively, and therefore forms a cuboid, the product of the intervals $[0,X_1]$, $[0,X_2]$ and $[0,X_3]$. By means of a known functional relationship f, which may be provided by a mathematical model or by a test setup, each determination variable $\underline{x}=(x_1,x_2,x_3)$ is assigned a target variable $\underline{y}=f(x)$, which lies in a target set Z. It is a subset of the in this case 2-dimensional target domain, i.e. $\underline{y}=(y_1, y_2)$, where $y_1$ and $y_2$ represent two characteristics which are to be optimized. The target set Z may be the complete image set of the determination set B under the mapping f or part of the same restricted by constraints.

The target variables of the solutions sought form a so-called Pareto front P (solid line), which bounds the target set Z with respect to small, i.e. favorable, values of the characteristics $y_1$, $y_2$. Laterally adjoining the Pareto front P are solutions which likewise lie on the border of the target set Z. They are not Pareto-optimal, since for each of the solutions a solution in which both characteristics are more favorable can be found on the Pareto front, but under some circumstances they may likewise be of interest.

It is then primarily a matter of finding determination variables $\underline{x}$ with which the associated target variables $\underline{y}=f(\underline{x})$ lie as close as possible to the Pareto front P. They are also to be distributed with some degree of uniformity over the entire Pareto front P and as far as possible also over the border areas adjoining the latter of the target set Z. Solutions of this type are generated by means of an iterative evolutionary or genetic algorithm, which forms the basis of a program which runs on a data-processing system. In this case, generally each variable is coded by a bit vector of a length L, which is for example 32.

For finding approximately Pareto-optimal solutions, firstly starting variables lying in the determination set B which, as the first set of determination variables, form the starting point of the iteration are generated. They may, for example, be distributed regularly or randomly over the determination set B. Then, as many iteration steps as it takes to satisfy a terminating criterion are carried out. This criterion may be that a specific maximum number of iteration steps has been carried out or a specific computing time has elapsed or else that the changing of the target variables has remained below a specific minimum during a specific number of iteration steps.

With each iteration step, the following substeps are carried out:

Recombination: new variables are respectively generated by combination of parts of a number of determination variables from the present set. For example, firstly either all the possible ordered pairs of determination variables are formed or else only some of those determined by means of a random generator. Each determination variable forms a vector comprising n real parameters. Then, a number l is likewise generated by means of a random generator, where $0 \leqq l \leqq n$, and then two new variables are formed in that the first l parameters are taken from the first determination variable and the remainder are taken from the second determination variable, and vice versa.

Mutation: for the variables generated in the recombination step, variables generated by means of a random generator, for example on the basis of a normal distribution, are added. Of course it is also possible in such a way to generate a number of starting variables from one variable.

Figure 5A:
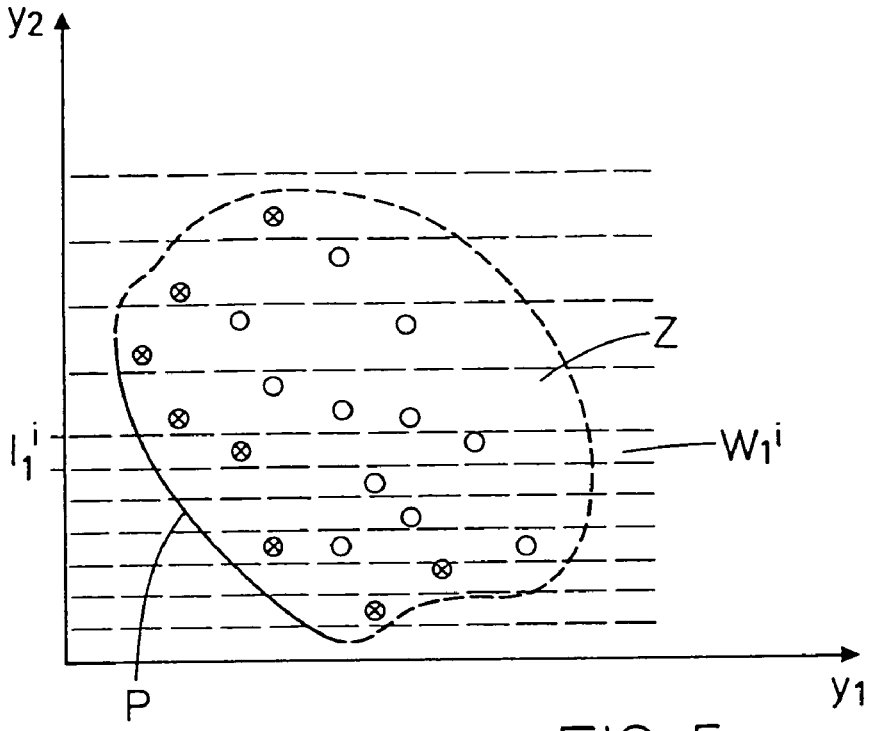

Selection: the two steps mentioned above produce a set of test variables which is generally greater than the original set of determination variables. From this usually relatively large set of test variables, a new set of determination variables which, on average, are particularly favorable is then selected. The procedure for the selection is of great significance for the development of the iteration. To control the approximation to the Pareto front P and two adjacent areas of the border of the target set Z, especially to achieve a broad approximation, the following procedure is preferably adopted:

In a first selection step, the hyperplane, identified by the condition $y_1=0$, of part of the target domain which comprises the target set Z and which in the 2-dimensional case represented (FIG. 5*a*) coincides with the $y_2$ axis, is subjected to a partition into subsets, which in this case form intervals $I_1^i$. Starting from this basis, the said part of the target domain is subdivided into subsets $W_1^i$, which are the original images of the orthogonal projections of the same along the positive $y_1$ axis onto the said intervals $I_1^i$. To put it another way, the subset $W_1^i$ for a specific i is the set of all points $\underline{y}=(y_1,y_2)$ in the said part of the target domain for which $y_1>0$ and $y_2$ lies in $I_1^i$. In FIG. 5*a*, it forms a strip parallel to the coordinate axis $y_1$.

For each of the non-overlapping subsets $W_1^i$, that test variable for which $y_1$ is optimal, i.e. minimal, is then determined and selected. In FIG. 5*a*, the target variables of all the test variables are marked by a circle O, those of the test variables selected in the individual $W_1^i$ are identified by a superposed multiplication symbol x.

Figure 5B:
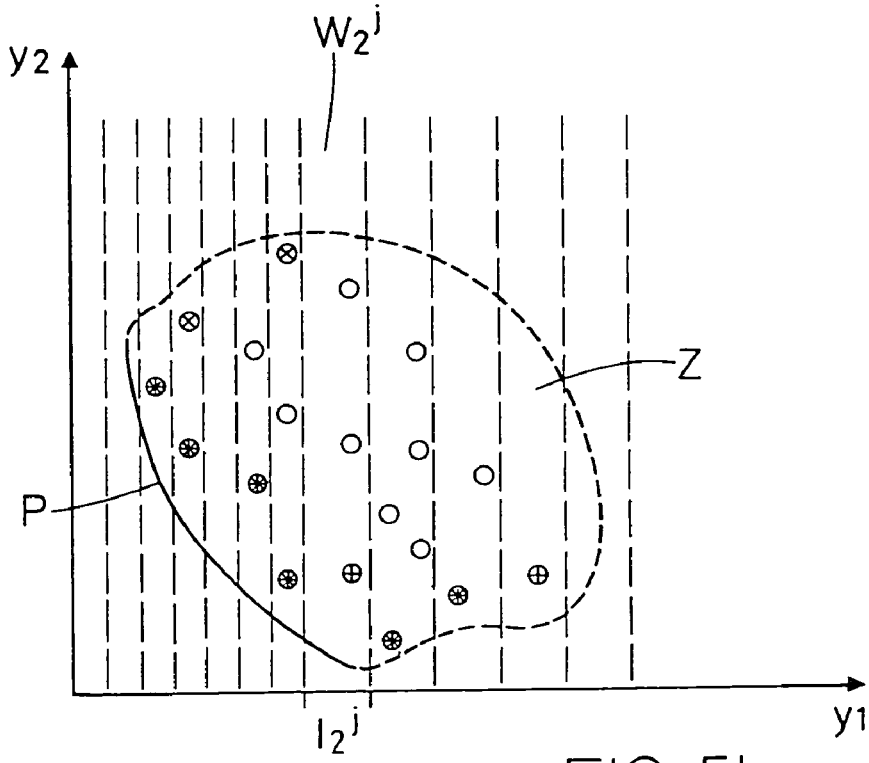

In a second selection step, the part of the target domain containing the target set Z is subdivided in an entirely analogous way into subsets $W_2^j$ and there, too, again for each subset that test variable for which $y_2$ is optimal, i.e. minimal, is determined and selected. The solutions are identified in FIG. 5*b* by a superposed plus symbol +. The new set of determination variables, with which the next iteration step is then undertaken, are composed of the test variables selected in both selection steps.

In relatively many cases, in particular in the proximity of the middle area of the Pareto front P, it is the same test variables that are determined in both cases, so that one selection step is usually adequate to establish these test variables. In the lateral border areas, and in particular in the part of the border of the target set Z adjoining the Pareto front P, this is generally not the case, however. If importance is also attached to the determination of solutions in these areas, it is necessary to carry out both selection steps.

There is of course also the possibility of respectively selecting in each of the subsets not just a test variable but a selection set of test variables, for example the k most favorable with regard to the remaining component, where $k>1$.

The procedure described for the selection can easily be transferred to cases in which the dimension m of the target domain is greater than 2. In this case, preferably all m hyperplanes which are characterized in that one of the coordinates $y_1, \ldots, y_m$ is equal to zero will be formed and a partition of the same into subsets carried out in each case. This can take place by each of the coordinate axes being subdivided into intervals from the outset and all the products of intervals into which the coordinate axes spanning the hyperplane are subdivided then respectively being used as subsets of a hyperplane.

In each of the subsets which are formed by the original images of the orthogonal projections onto the subsets of the hyperplanes, the test variable most favorable with respect to the remaining component is then selected and, finally, the union of the selected test variables is formed over the subsets and hyperplanes to produce the new set of determination variables. Depending on whether a determination of solutions that is as comprehensive as possible is of interest or, in particular, it is wished to establish solutions lying in specific areas, the selection may also consider only some of the hyperplanes, especially since, as explained above in the example, the central areas of the Pareto front are usually already covered quite well in the first selection step.

The actual procedure, determined by the algorithm, may of course deviate from that described above by a different combination of individual steps etc., in particular it is not absolutely necessary for the selection steps described to be carried out one after the other.

The subdivision into intervals may in each case be scaled uniformly or logarithmically, but may also be finer for instance in areas in which there is a particular interest. The partitions into subsets may be maintained or changed during the overall iteration, for example adapted to the distribution of the target variables. Instead of or in addition to hyperplanes, subdomains of a smaller dimension may also be used, but then optimization has to be carried out in each subset with respect to a number of characteristics, which requires further stipulations or a recursive procedure.

For instance, a wide variety of modifications of the procedure described are conceivable for the selection. The procedure described has the advantage that the stipulations regarding the position of the target variables allow the determination of the solutions to be respectively controlled in such a way that the target variables derived from the same are finally distributed in a desired way over a border area of the target set. Of course, various modifications are also possible for the recombination and the mutation. These substeps are also not both required in every case.

Figure 6A:
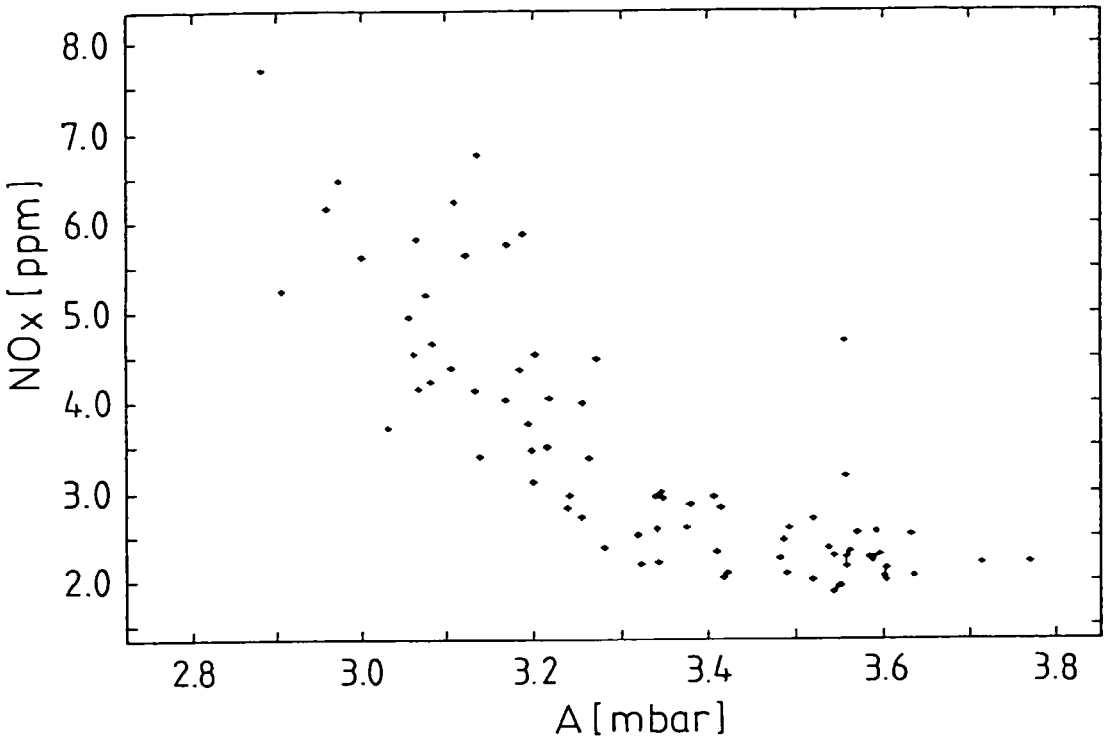
FIGS. 6*a, b* show the target domain of the present optimization problem after 20 and 64 iteration steps, respectively.
Figure 6B:
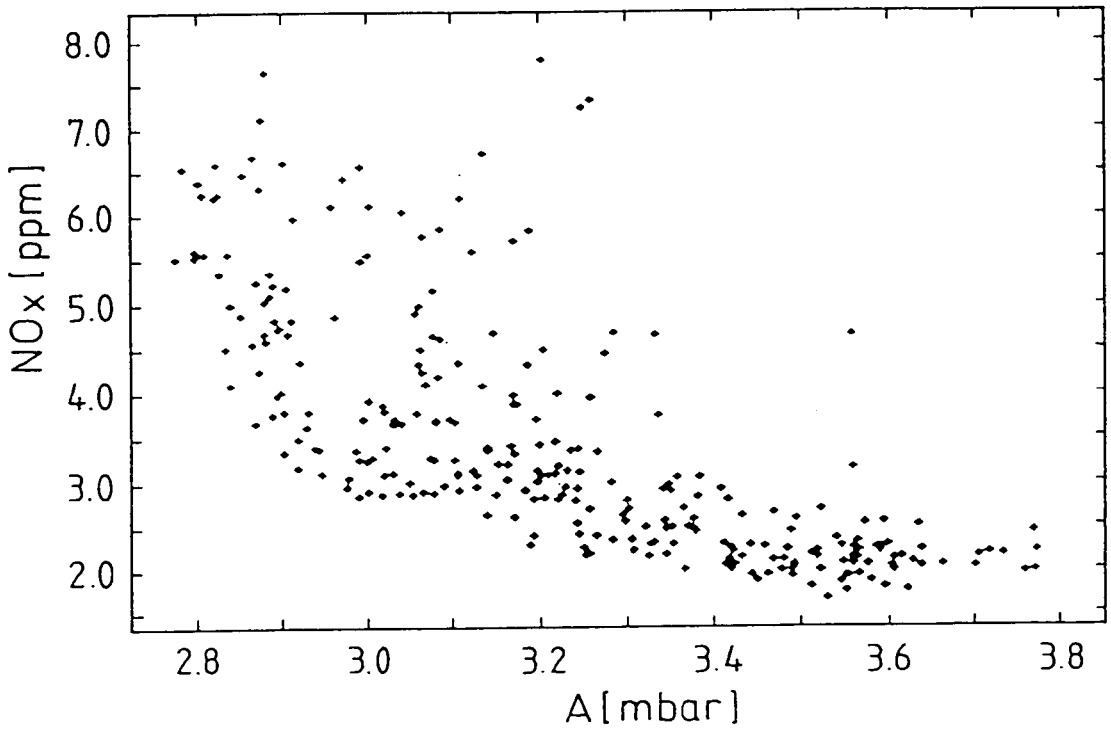

In the case of the present optimization problem, the determination domain is defined by the distributing parameters $p_1, \ldots, p_7$, which may respectively vary over the interval [0,1], the target domain, on the other hand, is defined by emissions and pulsations, in the example the two characteristics $NO_x$ content and maximum amplitude A of the pressure waves occurring. The target domain is represented in FIGS. 6*a*, 6*b*, to be precise with the target variables of the 100 solutions determined after 20 iteration steps (FIG. 6*a*) and the 320 solutions determined after 64 iteration steps (FIG. 6*b*). The two mappings clearly show how more and more, in particular favorable, solutions are determined and the limit of the set of target variables gradually emerges toward the favorable values of the characteristics—the Pareto front.

From the solutions determined, a specific solution is then selected, it being possible for further, possibly rather more intuitive, criteria to be included in the decision. The determination variable of the selected solution is then taken as a basis for the production of the burner system, especially the production or setting of the distributing device 5. Consequently, a burner system in which the distributing parameters $p_1, \ldots, p_7$, and consequently the mass flows $m_1, \ldots, m_8$, have been fixed such that they correspond to the determination variable of the selected solution is produced.

If, in addition to the control valves, the distributing device 5 also contains on/off valves, as represented in FIG. 1, the determination domain must be supplemented by corresponding binary switching parameters, which are respectively represented by a bit which can assume the values 0 for 'closed' and 1 for 'open'. The occurrence of these parameters changes virtually nothing concerning the way in which the optimization proceeds as described further above. A change is necessary only in the case of the mutation. Here it may be provided, for example, that each switching parameter, that is each bit, is inverted with a specific, for example fixed, probability, that is 0 changes into 1 and 1 changes into 0.

Figure 7:
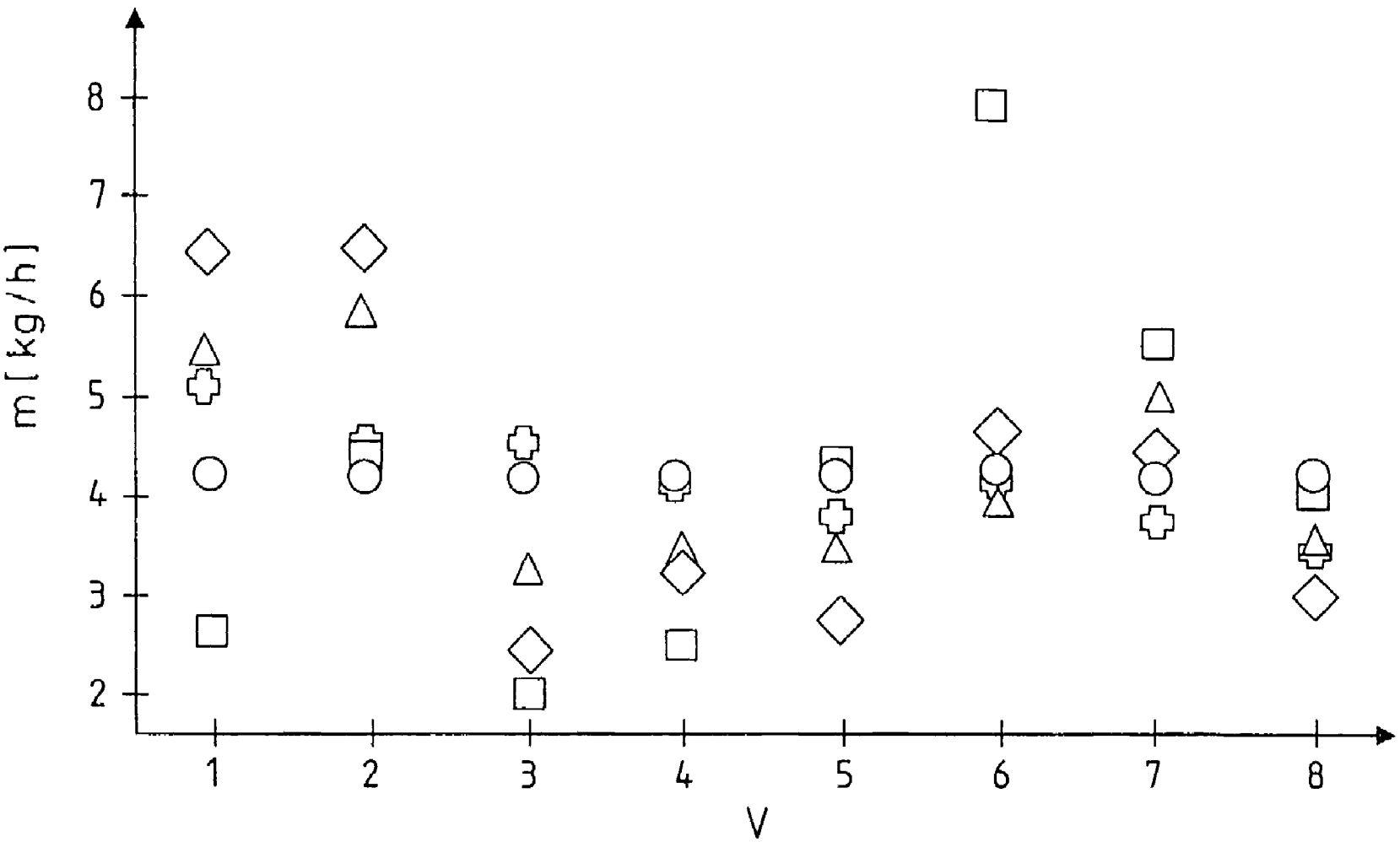
FIG. 7 shows mass flow distributions according to selected solutions of the optimization problem.

FIG. 7 shows as examples five different solutions, i.e. mass flow distributions, the x-axis showing the numbers of the control valves $V_1, \ldots, V_8$ and the y-axis showing the mass flows $m_1, \ldots, m_8$. The characteristics thereby achieved can be taken from the following table:

| Solution | Symbol | $NO_x$ content [ppm] | maximum amplitude [mbar] |
|---|---|---|---|
| 1 (equipartition) | Circle | 2.5 | 3.12 |
| 2 | Rhombus | 3.0 | 2.92 |
| 3 | Triangle | 4.0 | 2.83 |
| 4 | Cross | 5.0 | 2.80 |
| 5 | Square | 2.0 | 3.37 |

Solutions 3 and 4 offer particularly favorable values as far as the pressure surges occurring are concerned, while solution 5 shows the best exhaust gas values, although with high values for the pressure maximum. Solution 2, on the other hand, again offers very good characteristics in this respect, for which only a slightly increased $NO_x$ emission has to be accepted.

Of course, various deviations from the example described are possible. For instance, additional characteristics or different characteristics than those described, such as for example CO emission, average amplitude of the sound generated, and the like, can be taken as a basis for the optimization. The optimization method may also deviate from that described. It is also possible to carry out the search for Pareto-optimal solutions for different loads and corresponding values of the total mass flow M, and consequently to determine solutions which have favorable characteristics over a greater working range.

Finally, the solution which best meets the requirements is selected and a burner system in which the premix burners corresponding to that used in the test setup respectively have a fixed axial mass flow distribution which corresponds to the determination variable of the selected solution is produced. The setting of the desired mass flow distribution can in this case be performed in various ways. For example, distributing devices with restrictors or diverters which produce the desired fixed mass flow distribution in a way which is as simple and reliable as possible may be used in the burner system. The mass flow distribution may, however, also be set very simply by the dimensioning, especially the diameters of the inlet openings. In this case, the distributing device may be in each case comprise a pipe system which connects its input to the inlet openings.

| List of designations | |
|---|---|
| 1 | premix burner |
| 2 | opening |
| 3a, b | air inlet slots |
| 4 | inlet openings |
| 5 | distributing device |
| 6 | main line |
| 7 | input valve |

-continued

| List of designations | |
|---|---|
| 8 | branch lines |
| 9 | data-processing system |
| 10 | control unit |
| 11 | measuring unit |

The invention claimed is:

1. A method for producing a burner system having a fuel source, at least one swirl-stabilized premix burner having a plurality of inlet openings, and a distributing device by which the plurality of inlet openings in the premix burner are connected to the fuel source, the method comprising:

determining a desired mass flow distribution into the at least one premix burner;

generating determination variables fixing the mass flow distribution, comprising vectors from a determination set which is a subset of an n-dimensional domain, one after the other with a data-processing system;

setting a mass flow distribution in a test setup with at least one premix burner and at least one adjustable distributing device, the mass flow distribution being set based on each determination variable, and measuring a target variable, comprising a vector from a target set which is a subset of an m-dimensional domain, on the test setup; and selecting a determination variable on the basis of the target variables;

wherein the at least one premix burner or the at least one distributing device of the burner system is configured such that the mass flow distribution corresponds to that which is fixed by the selected determination variable.

2. The method as claimed in claim 1, further comprising:

forming the components of the determination variables at least partly by the distributing parameters of the branching points of a tree structure, by which tree structure the distribution of the mass flow between inlet openings or groups of inlet openings of the at least one premix burner is determined.

3. The method as claimed in claim 1, further comprising:

determining Pareto solutions, wherein for every solution in which one component of the target variable has a more favorable value, at least one other component has a less favorable value, at least approximately with the data-processing system; and selecting a determination variable from among the Pareto solutions.

4. The method as claimed in claim 3, wherein determining Pareto solutions comprises determining starting variables serving as a set of determination variables; and further comprising:

carrying out iteration steps with the data processing system until a terminating criterion is satisfied including determining a new set of determination variables from a set of determination variables by generating from the set of determination variables a set of test variables respectively lying in the determination set, from which set of test variables the new set of determination variables is selected in each case on the basis of the target variables which were measured for the mass flow distribution fixed by the determination variables.

5. The method as claimed in claim 4, wherein generation of the test variables from the set of determination variables comprises random mutation or recombination of the determination variables using the data-processing system.

6. The method as claimed in claim 1, wherein the concentration of at least one pollutant forms a component of the target variable.

7. The method as claimed in claim 1, wherein a measure of the pulsations occurring in the burner system forms a component of the target variable.

8. The method as claimed in claim 1, wherein the inlet openings are provided at least partly axially in succession.

9. The method as claimed in claim 1, further comprising:

dimensioning the inlet openings at least partially to achieve the desired mass flow distribution.

10. The method as claimed in claim 1, wherein the distributing device comprises restrictors, diverters, or both, to achieve the desired mass flow distribution.

11. The method as claimed in claim 6, wherein the at least one pollutant comprises NOx concentration in an exhaust gas.

12. The method as claimed in claim 7, wherein the measure of the pulsations comprises pulsation maximum amplitude.

13. The method as claimed in claim 4, wherein selection of the new set of determination variables from the set of test variables involves determining a plurality of coordinates of the target set, and for each of them dividing the hyperplane characterized by the coordinate equaling zero into subsets, selecting, in the inverse image of each subset under orthogonal projection parallel to the said coordinate, according to the value of its component which corresponds to the said coordinate, at least one target variable which was measured for the mass flow distribution fixed by a test variable, and adding the at least one test variable to the new set of determination variables.

* * * * *